United States Patent [19]

Bergman et al.

[11] Patent Number: 4,881,907

[45] Date of Patent: Nov. 21, 1989

[54] CONDUCTOR STRIP FOR ELECTRICAL AND TELECOMMUNICATION CONDUCTORS

[76] Inventors: Nils-Åke Bergman, Junivägen 24; Harald Widell, Kalendervägen 25; Jan Widell, Augustivägen 11, all of S-352 47 Växjö , Sweden

[21] Appl. No.: 216,716

[22] PCT Filed: Dec. 18, 1986

[86] PCT No.: PCT/SE86/00579

§ 371 Date: Jun. 23, 1988

§ 102(e) Date: Jun. 23, 1988

[87] PCT Pub. No.: WO87/03998

PCT Pub. Date: Jul. 2, 1987

[30] Foreign Application Priority Data

Dec. 23, 1985 [DE] Fed. Rep. of Germany ... 8536122[U]

[51] Int. Cl.[4] ..... H01R 13/60

[52] U.S. Cl. ..... 439/111; 439/586; 439/933; 439/110; 174/117 F

[58] Field of Search ..... 174/70 C, 97, 117 R, 174/117 F; 439/110–112, 207, 492, 586, 590, 933

[56] References Cited

U.S. PATENT DOCUMENTS

| | | | |
|---|---|---|---|
| 2,062,752 | 12/1936 | Kindberg | 439/111 |
| 2,240,180 | 4/1941 | Frank | 439/111 |
| 2,254,068 | 8/1941 | Frank | 439/111 |
| 2,396,725 | 3/1946 | Thomas, Jr. | 439/590 |

FOREIGN PATENT DOCUMENTS

| | | | |
|---|---|---|---|
| 840863 | 6/1952 | Fed. Rep. of Germany | 174/117 F |
| 2012482 | 1/1971 | Fed. Rep. of Germany . | |
| 2004420 | 8/1971 | Fed. Rep. of Germany | 439/590 |
| 2103319 | 8/1971 | Fed. Rep. of Germany . | |
| 2333170 | 1/1975 | Fed. Rep. of Germany . | |
| 2737487 | 3/1978 | Fed. Rep. of Germany . | |
| 3347196 | 7/1985 | Fed. Rep. of Germany . | |
| 3527846 | 2/1987 | Fed. Rep. of Germany | 174/117 F |
| 977878 | 11/1950 | France | 174/97 |
| 453106 | 12/1950 | Italy | 439/590 |
| 406850 | 2/1979 | Sweden . | |

OTHER PUBLICATIONS

"Optical Fiber Ribbon Cable", IBM Tech. Discl. Bulletin, vol. 20, No. 10, Mar. 1978.

*Primary Examiner*—Gary F. Paumen

*Attorney, Agent, or Firm*—Davis, Bujold & Streck

[57] ABSTRACT

Conductor strip (1) for electrical and telecommunication conductors with one or several through metallic conductors (9), which are arranged to be connected up at any selected position, and which are arranged on or in an electrically non-conductive strip base (5). The metallic conductor or conductors (9) is or are embedded in a through electrically conductive string or cord (8) of plastic material. Because of the inherent resiliency of the material and/or the springiness of the strip structure, the conductor strip (1) is automatically lockable by expansion or outward springing of the strip, whereat the free ends of the strip (1) are caused to engage behind projections (4) of an installation channel (3).

10 Claims, 2 Drawing Sheets

CONDUCTOR STRIP FOR ELECTRICAL AND TELECOMMUNICATION CONDUCTORS

The present invention relates to a conductor strip for electrical and telecommunication conductors.

BACKGROUND OF THE INVENTION

Such conductor strips are placed to advantage in so-called installation channels or wiring channels and are arranged for electrical connection thereto at any selected position. This avoids the necessity of carrying out wiring and cable installations at a later date, such work often being expensive, time-consuming and requiring cavities or the like to be made in the walls, ceiling of the relevant building structure, which can detract from the aesthetic appearance of the building.

When using present day conductor strips in installation channels, the conductors are still liable to present certain problems. This is particularly true of copper wire embedded in non-conductive plastic strip sections, and more particularly when introducing the wire into the strip, either by hand or with the aid of expensive mechanical devices. This causes the strip sections to be relatively expensive, and often unreliable. In addition, the sections must be constructed with a view to enabling the introduction of metal conductors thereinto, or to facilitate such introduction, which means that the sections are not given an optimal design which, for example, would enable the sections to be manufactured quickly and in simple fashion; ensure beneficial electrical insulation; exert a guaranteed contact pressure; and enable the sections to be produced simultaneously with electrical wiring and conductors for telecommunication and control systems.

SUMMARY OF THE INVENTION

The object of the present invention is to eliminate the aforesaid disadvantages and to provide a novel conductor strip for accommodating electric-current supply cables and supply cables for telecommunication and control communication systems, said conductor strips being in principle beneficial to the art and fulfilling the most diverse demands.

According to the invention, there is provided a conductor strip (1, 1', 1") for electrical and telcommunication connectors, with at least one electrical conductor (9, 12, 19) arranged along substantially the entire length of the strip for electrical contact to be made therewith at any selected position, and said conductor is arranged on the surface of an electrically non-conductive strip base (5), characterized in that the strip base (5) has free edges, is made of a flat resilient material, and is provide with notches (6) which extend the length of the strip base and which allow the strip base (5) to be bent at approximately ninety degree angles into a desired shape, and the conductor strip (1, 1', 1"), because of the inherent resiliency of the strip base material, is automatically lockable by resilient expansion of the conductor strip when the free edges of the strip engage behind projections (4) of an installation channel (3). According to the Present invention.

Further characteristic features of the invention and advantages afforded thereby will be apparent from the following description made with reference to a number of non-limiting embodiments illustrated partially schematically in the accompanying drawings, in which

DETAILED DESCRIPTION OF THE INVENTION

Figure 1:
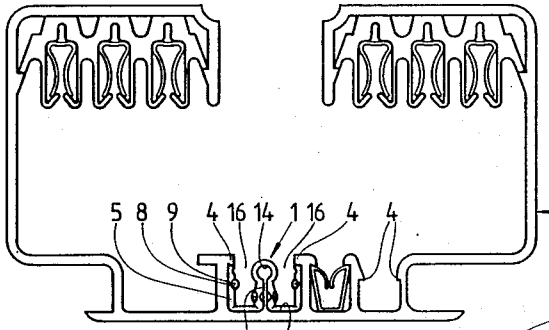
FIG. 1 illustrates an installation channel having arranged therein a conductor strip according to the invention.

FIG. 1 incorporates a continuous conductor strip according to the invention, which is denoted by the general reference numeral 1. The strip can have any desired length and is pressed into a continuous recess 2 in an installation channel 3, the strip 1 being locked automatically in the recess 2 as a result of the expansion or outward springing of the strip due to the inherent resiliency of the material from which the strip is made and/or the springiness of the strip structure, said expansion or outward springing action causing the free edges of the strip to engage behind projections 4 of recess 2. FIG. 1 also illustrates the integration of electrically conductive and non-conductive parts of the strip, which will be described in detail hereinafter.

Figure 2:
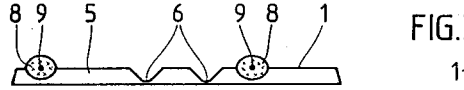
FIG. 2 illustrates a second conductor strip according to the invention as manufactured, which is ready for storage and ready for delivery.
Figure 3:
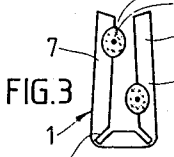
FIG. 3 illustrates the conductor strip of FIG. 2 in its in-use position.

In the embodiment shown in FIG. 2 the conductor strip according to the invention comprises a flat base 5 made from an electrically non-conductive plastic, preferably PVC; ABS, for example NORYL ® (registered trademark owned by General Electric). The base 5 is provided with notches 6 which enable the strip to be bent, preferably to the form of a U, as illustrated in FIG. 3, the geometric transition regions providing a desired outwardly directed elastic force/tension, such as to hold the strip 1 positively at the rear of a recess 2 in an installation channel or duct 3. Each leg 7 of the conductor strip has incorporated therein at mutually off-set locations, i.e. locations which do not lie opposite on another, a string or cord 8 preferably of electrically plastics including conductive material and a metallic conductor 9, preferably copper wire, as evident from FIGS. 2 and 3, which shown the conductor 9 embedded centrally in the string 8 or plastic material. Commercially available CARBEN BLACK and POLYOTEFIN are examples of suitable electrically conductive loadings for plastic materials in the present context. One constituent of CARBEN BLACK is carbon black. In addition hereto, however, or principally, powdered metal, such as powdered copper for example, can also be embedded in the string 8 of electrically conductive plastic. The reason for embedding one or more metal wires or filaments 9 is firstly to increase or improve electric conductibility and secondly to hold the string together in the event of the string being subjected to extreme, unfavourable conditions under which cracks may form.

Figure 6:
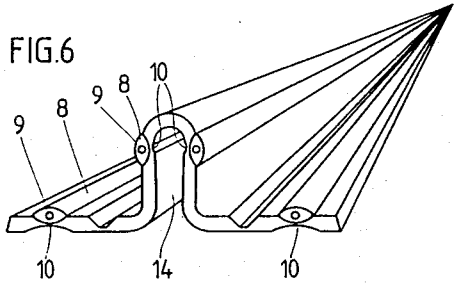
FIG. 6 illustrates a fourth conductor strip according to the invention as manufactured etc.

As will be seen rom FIGS. 2 and 3, the electrically conductive strings 8 extend out from respective sides of the base 5, thereby enabling, for example, contact pins to be bent to provide a desired contact pressure. A still greater advantage is obtained when the side of the base 5 adjacent the electrically conductive string 8 is provided with depressions 10, so as to enable the actual string region itself to deflect elastically, for example in the manner illustrated in FIGS. 6 and 14.

Figure 4:
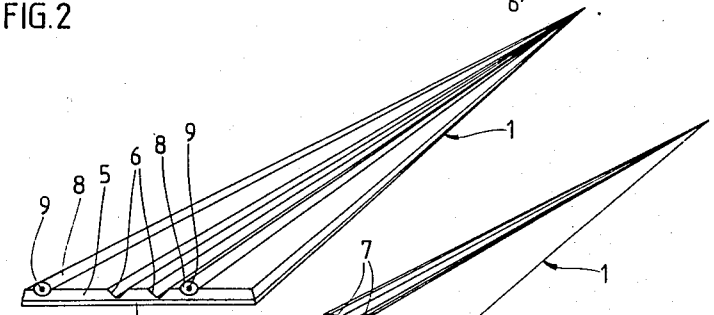
FIG. 4 illustrates a third conductor strip according to the invention as manufactured etc.
Figure 5:
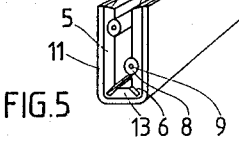
FIG. 5 illustrates the conductor strip of FIG. 4 in its in-use position.
Figures 11, 12, 13, 14, 15, 16, 17, 18, 19:
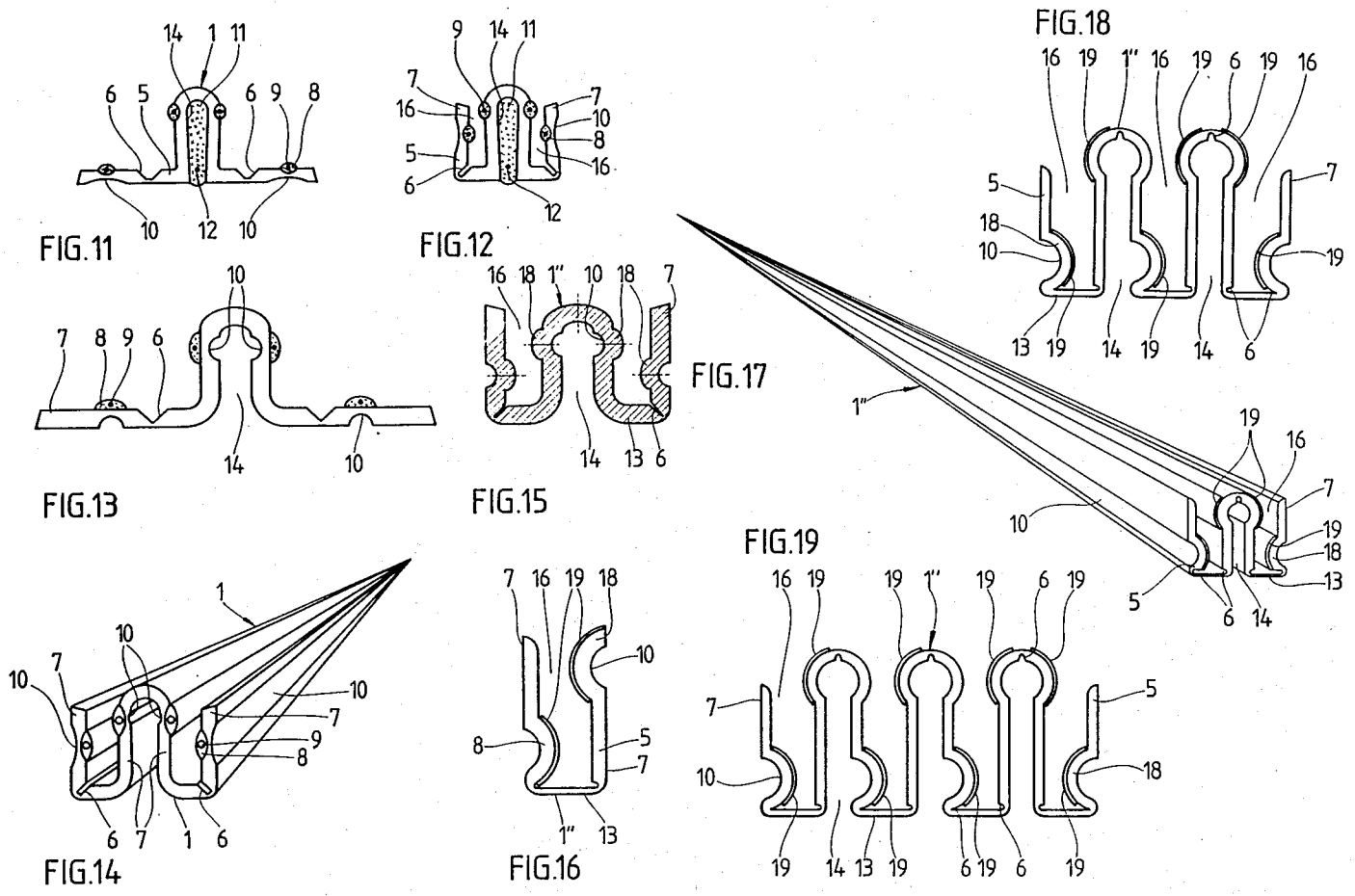
FIG. 11 illustrated a seventh conductor strip according to the invention as manufactured etc.
FIG. 12 shows the strip of FIG. 11 in its in-use position.
FIG. 13 illustrates an eighth conductor strip according to the invention as manufactured etc.
FIG. 14 shows the strip of FIG. 13 in its in-use position.
FIG. 15 illustrates a ninth conductor strip base according to the invention in its in-use position.
FIGS. 16–19 are cross-sectional views of four further conductor strips, these strips exhibiting electrically conductive metal and/or plastic foils.

A particular advantage is obtained when the strip 1 according to the invention is of a flat or partially flat construction, in which the conductive strings 8 can be readily fitted. This enables the most widely differing designs to be achieved, as indicated in the different figures. In this regard, it is possible to apply to the side of the base 5 opposite the conductive strings 8 a further conductive layer 11, functioning for example, as a ground conductor, as illustrated in FIGS. 4 and 5 for example. This ground conductor 11 may also be provide with a centrally located metal wire or filament 12, as illustrated in FIGS. 11 and 12.

The various layers and strings or the like of plastic material are welded together or adhesively bonded together in a manner known per se.

As illustrated in FIG. 1, the base 5 may be provided on the side thereof opposite the conductive strings 8 with a central cavity 14 effective to embrace an outwardly extending longitudinal rib 15 in an installation channel 3 or, as previously mentioned, may be used to accommodate an earth conductor 11 or to produce an additional conductive string 11.

Figure 7:
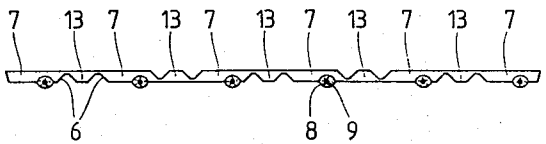
FIG. 7 illustrates a fifth conductor strip according to the invention as manufactured etc.
Figure 8:
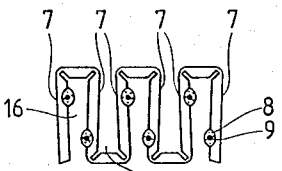
FIG. 8 shown the strip of FIG. 7 in its in-use position.
Figure 9:
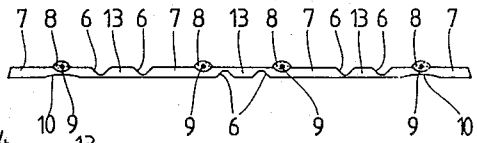
FIG. 9 illustrates a sixth conductor strip according to the invention as manufactured etc.
Figure 10:
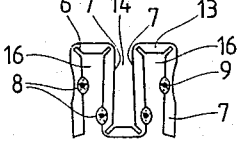
FIG. 10 shows the strip of FIG. 9 in its in-use position.

As illustrated in FIGS. 7 and 9 the inventive strip according to the invention may comprise an arbitrary multiple of leg portions 7 and web portions 13 separated by notches 6. The conductive strips of FIGS. 7 and 9 are shown as manufactured, ready for storage and ready for delivery. Before use they are folded together into the positions shown in FIGS. 8 and 10 respectively, thus forming between the legs 7 a number of central cavities 14 and contact pin cavities 16, the latter having electrically conductive strings 8.

The electrically conductive strings can either be partially buried into the base 5 as described above or be arranged on the surface thereof. FIGS. 15–19 illustrate examples of conductive strips 1″ of the latter type. FIG. 15 shows a conductor strip 1″ comprising a base 5 bent into a position of use, but before application of electrically conductive elements 19 such metallic and/or plastic foils. Another purpose with the conductor strip as shown in FIG. 15 can be to use it without electrically conductive elements for special applications.

The conductive strip 1″ comprises leg portions 7 and web portions 13 separated by notches 6. the leg portions 7 exhibit bent parts 18 forming depressions 10 facing central cavities 14 or the walls of a recess 2, for instance in an installation channel 3. The opposite convex surface of the bent parts 18 are covered by electrically conductive elements, such as metallic and/or plastic foils 19 as shown in FIGS. 16-19. Also the conductive strip 1″ has a flat or partially flat construction as manufactured in the same manner as the first described embodiment of the conductive strip 1.

End caps made of an electrically insulating material can be fitted on the severed ends of the strip, when cut on the installation side. Severed ends of the strip can also be attached to conductor joints for connection with another strip or other electrical conductors.

We claim:

1. A conductor strip (1, 1′, 1″) for electrical and telecommunication connectors, with at least one electrical conductor (9, 12, 19) arranged along substantially the entire length of the strip for electrical contact to be made therewith at any selected position, and said conductor is arranged on the surface of an electrically non-conductive strip base (5), characterized in that the strip base (5) has free edges, is made of a flat resilient material and is provide with notches (6) which extend the length of the strip base and which allow the strip base (5) to be bent at approximately ninety degree angles into a desired shape, and the conductor strip (1, 1′, 1″), because of the inherent resiliency of the strip base material, is automatically lockable by resilient expansion of the conductor strip when the free edges of the strip engage behind projections (4) of an installation channel (3).

2. A conductor strip as claimed in claim 1, characterized in that the base (5) is of a flat or partially flat construction.

3. A conductor strip as claimed in claim 1, characterized in that the strip (1, 1″) has at least two opposed legs (5, 7) which are provided with at least one of an electrically conductive foil (19) and an electrically conductive string or cord (8, 11) of plastic material having a metallic conductor (9, 12) therein.

4. A conductor strip as claimed in claim 3, characterized in that the electrically conductive plastic material (8, 11) is a plastic material available under one of the following trademarks: CARBEN BLACK and POLYOTEFIN, and a metallic powder embedded in the plastic material is the metallic conductor.

5. A conductor strip as claimed in claim 3, characterized in that the electrically conductive string or cord (8) and the foil (19) extend on respective sides of the base (5), and depressions (10) are formed in the side of the base (5) adjacent the electrically conductive string or cord (8) is cut away or otherwise exhibits 6. A conductor strip as claimed in claim 1, characterized in that the strip (1, 1″) is manufactured and can be stored as a flat or partially flat construction, and can be bent into its intended final shape upon installation thereof in said installation channel (3).

7. A conductor strip as claimed in claim 1, characterized by a cavity (14) being formed between two opposed strip legs (7) to embrace an outwardly extending rib means (15) of said installation channel (3).

8. A conductor strip as claimed in claim 1, characterized in that the electrically non-conductive base material (5) is able to be at least partially penetrated by contact pins means.

9. A conductor strips claimed in claim 1, characterized in that the base (5) is made from one of PVE, ABS and NORYL non conductive plastic materials.

10. A conductor strip as claimed in claim 1, characterized by a cavity (14) being formed between two opposed strip legs (7) to accommodate an earth conductor (11) or an additional conductor string or cord (11).

* * * * *

UNITED STATES PATENT AND TRADEMARK OFFICE

CERTIFICATE OF CORRECTION

PATENT NO. : 4,881,907

DATED : November 21, 1989

INVENTOR(S) : Nils-Ake BERGMAN, Harald WIDELL and Jan WIDELL

It is certified that error appears in the above—identified patent and that said Letters Patent is hereby corrected as shown below:

Column 4, line 48 - after "(8)" delete "is cut away or otherwise exhibits";

Column 4, line 48 - after "(8)" insert "so as to enable the string or cord to deflect elastically upon insertion of contact pin means.";

Column 4, line 62 - change "PVE" to "PVC"

Signed and Sealed this

Eleventh Day of December, 1990

*Attest:*

HARRY F. MANBECK, JR.

*Attesting Officer*

*Commissioner of Patents and Trademarks*